US006649314B1

(12) United States Patent
Visser et al.

(10) Patent No.: US 6,649,314 B1
(45) Date of Patent: Nov. 18, 2003

(54) PROCESS FOR REDUCING IMAGE DEFECTS IN AN ELECTROSTATOGRAPHIC APPARATUS CONTAINING PARTICULATE CONTAMINANTS

(75) Inventors: Susan A. Visser, Rochester, NY (US); Donald S. Rimai, Webster, NY (US); Paul M. Borsenberger, deceased, late of Rochester, NY (US), by Diana D. Parker, legal representative

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/506,159

(22) Filed: Feb. 17, 2000

(51) Int. Cl.[7] ..... G03G 13/22

(52) U.S. Cl. ..... 430/100; 430/67; 430/124; 430/126

(58) Field of Search ..... 430/66, 67, 46, 430/48, 103, 126, 100, 124; 399/32, 296

(56) References Cited

U.S. PATENT DOCUMENTS

| | | | | |
|---|---|---|---|---|
| 3,615,414 A | | 10/1971 | Light | |
| 3,984,182 A | * | 10/1976 | Gundlach et al. | 399/296 |
| 4,082,551 A | | 4/1978 | Steklenski et al. | 428/420 |
| 4,175,960 A | | 11/1979 | Berwick et al. | 430/74 |
| 4,602,863 A | | 7/1986 | Fritz et al. | 118/657 |
| 4,886,722 A | | 12/1989 | Law et al. | 430/60 |
| 4,895,782 A | | 1/1990 | Koyama et al. | 430/76 |
| 5,202,207 A | | 4/1993 | Kanemaru et al. | 430/76 |
| 5,213,927 A | | 5/1993 | Kan et al. | 430/66 |
| 5,240,802 A | * | 8/1993 | Molaire et al. | 430/67 |
| 5,255,057 A | * | 10/1993 | Stelter et al. | 39/285 |
| 5,324,605 A | | 6/1994 | Ono et al. | 430/73 |
| 5,330,865 A | | 7/1994 | Leus et al. | 430/78 |
| 5,332,635 A | | 7/1994 | Tanaka | 430/96 |
| 5,370,961 A | * | 12/1994 | Zaretsky et al. | 430/126 |
| 5,614,342 A | | 3/1997 | Molaire et al. | 430/78 |
| 5,783,343 A | * | 7/1998 | Tombs et al. | 430/47 |
| 5,786,119 A | | 7/1998 | Sorriero et al. | 430/96 |
| 5,807,651 A | | 9/1998 | Rimai et al. | 430/11 |
| 5,853,941 A | * | 12/1998 | Rimai et al. | 430/122 |

FOREIGN PATENT DOCUMENTS

| | | | | |
|---|---|---|---|---|
| JP | 63-81366 | * | 4/1988 | 430/66 |

OTHER PUBLICATIONS

Derwent Abstract 88–138104/20 of JP 63–81366 (abstract is attached to JP 63–81366 ), 1988.*

US Patent & Trademark Office (PTO) English–Language Translation of JP 63–081366, Apr. 1988.*

Diamond, A.S., ed Handbook of Imaging Materials, Marcel Dekker, Inc, NY (1991), pp. 160–162.*

Schaffert, R.M., *Electrophotography*, John Wiley & Sons, NY (1975), pp 55–56, 1975.*

US Patent & Trademark Office English–Language Translation of JP 1–219858 (pub Sep. 1989).*

W. Sorenson and T. Campbell, *Preparative Methods of Polymer Chemistry*, Interscience (1968), Schotten–Baumann, pp 137–139.

* cited by examiner

*Primary Examiner*—Janis L. Dote

(57) ABSTRACT

A process for reducing image defects in an electrostatographic image resulting from particulate contamination. A primary imaging member, including a photoconductive element and an outermost layer of silicon carbide, is uniformly charged in an electrostatographic imaging apparatus subject to particulate contamination. The electrostatographic imaging apparatus includes a charging station, an exposing station, at least one developing station, and a transfer station comprising an electrically biased roller transfer assembly. The primary imaging member is exposed imagewise at the exposing station to form a latent image on the imaging member, which is thereafter developed with toner at the developing station to form a developed image on the imaging member. The primary imaging member bearing the developed image is passed through a charge erasing station to remove residual surface charge, then contacted with a receiver by the electrically biased roller transfer assembly, causing the developed image to transfer to the receiver. The silicon carbide layer protects the photoconductive element against damage by contaminant particles present in the apparatus.

14 Claims, 1 Drawing Sheet

PROCESS FOR REDUCING IMAGE DEFECTS IN AN ELECTROSTATOGRAPHIC APPARATUS CONTAINING PARTICULATE CONTAMINANTS

FIELD OF THE INVENTION

The present invention relates in general to electrostatography and, in particular, to a process for reducing image defects an electrostatographic imaging apparatus that contains particulate contaminants.

BACKGROUND OF THE INVENTION

Electrostatographic imaging apparatus in general and electrophotographic imaging apparatus and techniques in particular have been extensively described in patents and other literature. In general, electrostatographic apparatus comprises a primary imaging member such as a photoconductive element, on which an electrostatic latent image can be formed. The latent image is then developed into a visible image using an appropriate developer contained in a suitable development station. The developed image is transferred from the primary imaging member to a receiver, where it is permanently fixed using a suitable process such as fusing. Alternatively, the image can be first transferred to a transfer intermediate member and thence to the receiver. Such an intermediate transfer member is described in Rimai et al., U.S. Pat. No. 5,807,651, ELECTROSTATOGRAPHIC APPARATUS AND METHOD FOR IMPROVED TRANSFER OF SMALL PARTICLES, the disclosure of which is incorporated herein by reference. In order to produce color images, separate latent images comprising the appropriate color information are produced on the primary imaging member, converted into visible images using developers contained in multiple development stations, and ultimately transferred to a receiver using known methods.

For the specific case of an electrophotographic apparatus and process, the primary imaging member comprises a photoconductive element, which is initially electrically charged using known technology such as a corona or roller charger. An electrostatic latent image is then formed by image-wise exposing the photoconductive element to suitable electromagnetic radiation, using, for example, optical exposure or a laser scanner or LED array. The electrostatic latent image is developed into a visible image by bringing the photoconductive element of the primary imaging member into close proximity to a development station containing a suitable developer comprising toner particles of appropriate color and electric charge.

The development process can be either a discharged area development (DAD) process, in which the toner is deposited on the discharged areas of the photoconductive element, or a charged area development (CAD) process, wherein the toner is deposited on the charged areas of the photoconductive element. In the DAD process, the toner charge generally is of the same polarity as the initial charge on the photoconductive element. The development station is also biased with a potential of the same polarity at a level that is relatively high but lower than the initial charge on the photoconductive element. In the CAD process, the polarity of the toner charge is generally opposite that of the initial charge on the photoconductive element. The development station is biased at a level lower than that of the initial charge on the photoconductive element but generally higher than that residing in the discharged areas of the element.

The primary imaging member comprising the photoconductive element generally also includes a substrate that can be in the form of, for example, a continuous web or a drum. The substrate must itself either be electrically conductive or be coated with a suitable electrically conducting layer such as nickel. The electrically conductive substrate or overcoat layer is then overcoated with a layer that will hold the charge during most of the latent image forming and development process but can be imagewise discharged at the appropriate instances. The substrate overcoat generally comprises a material with photoconductive properties. The primary imaging member can further include suitable additional layers such as, for example, charge transport layers, protective layers such as sol-gels, additional photoconductive layers sensitive to different frequencies in the electrophotographic spectrum, etc.

Development of a latent image formed by imagewise exposure of the photoconductive element is accomplished by passing the element over a suitable development station containing a dry powder developer. It is important that the charge-holding photoconductive layer overlying the electrically conducting layer or conductive substrate be continuous and free of any defects such as "pin holes." While primary imaging members can be manufactured initially free of defects, pin hole type defects of the charge holding layer are known to occur during use. These are generally caused by punctures of the photoconductive layer by contaminant particles. These punctures are frequently found to occur at the transfer station, especially when electrostatic transfer is used and, more particularly, when the electrostatic transfer apparatus comprises a pressure member such as a roller that presses the receiver or intermediate member into contact with the primary imaging member. Although the sources of such particulate contamination are broad, it is frequently found to occur with magnetic carrier particles contained in so-called "two component" developers. Other sources of particulate contaminants include carbon or fiberglass reinforcing fibers contained in molded articles within the apparatus, paper filler, etc. Other components contained in the developers, including silica, titania, strontium titanate, barium titanate, etc. can also cause punctures.

The presence of pin holes will result in small discharged areas that do not correspond to the latent image and will produce noticeable defects in the developed image. In the case of the DAD process, an area of the photoconductive element having reduced charge acceptance attracts toner during the development process, resulting in a phenomenon known as "black spots." Black spots refer specifically to deposits of toner on the latent image in areas or spots that were not discharged solely by imagewise exposure of the photoconductive element. In an image comprising black text on a white background, black spots are manifested as random black dots in the background areas. The term "black spot" is used generically but can refer to spots of any other color toner used in the development of a particular latent image. For example, if the defect occurs in a latent image separation of a full color image comprising the cyan information, the "black spot" will actually be cyan in color.

A similar problem occurs in CAD electrophotographic processes. In this case, an area of the photoconductive element with reduced charge acceptance will fail to attract toner during the development process, even if that area is within the image area that should be toned. This gives rise to a phenomenon known as "white spots". White spots refer specifically to the reduction or absence of toner deposits on the latent image in areas or spots that were not discharged solely by imagewise exposure of the photoconductive element. In the case of an image comprising a black or colored image, white spots are manifested as random white dots in the black or colored areas.

Clearly, the presence in an image of black spots in a DAD system or white spots in a CAD system reduces quality of the image, leading to lowered productivity and increased calls for service. Thus there is a need for a method of preventing black or white spots in electrostatographic image producing apparatus in general and electrophotographic apparatus in particular. The present invention describes a method for reducing image defects resulting from puncture of a photoconductive element at the transfer station of an electrostatographic apparatus prone to particulate contamination. Images with significantly fewer black spots or white spots are thereby obtained.

SUMMARY OF THE INVENTION

The present invention is directed to a process for reducing image defects in an electrostatographic image resulting from particulate contamination. The process comprises: uniformly charging a primary imaging member that comprises a photoconductive element and an outermost layer of silicon carbide and is included in an electrostatographic imaging apparatus subject to particulate contamination. The apparatus further includes a charging station, an exposing station, at least one developing station, and a transfer station that comprises an electrically biased roller transfer assembly. The primary imaging member is exposed imagewise at the exposing station to form a latent image on the imaging member, which is developed with toner at the developing station to form a developed image on the imaging member.

The primary imaging member bearing the developed image is passed through the charge erasing station to remove residual surface charge, then contacted with a receiver by the electrically biased roller transfer assembly, causing the developed image to transfer to the receiver. The outermost layer of silicon carbide protects the photoconductive element against damage by contaminant particles present in the apparatus and thereby mitigates generation of image defects in the roller transfer assembly of the developer station.

DETAILED DESCRIPTION OF THE INVENTION

The initial image-forming step in electrophotography is the creation of an electrostatic latent image on the surface of a primary imaging member by charging a photoconductive element included in the imaging member to a positive or negative potential of several hundred volts using a roller charging device, followed by exposure of the member in an imagewise fashion to form an imagewise charge pattern known as the latent image. Suitable means for exposing the photoconductive element to form the latent image include optical exposure, laser scanning, or exposure by a light-emitting diode (LED) array. In the subsequent development step, electrophotographnc toner of an appropriate color and electric charge is deposited on photoconductive element of the primary imaging member bearing the latent image.

Figure 1:
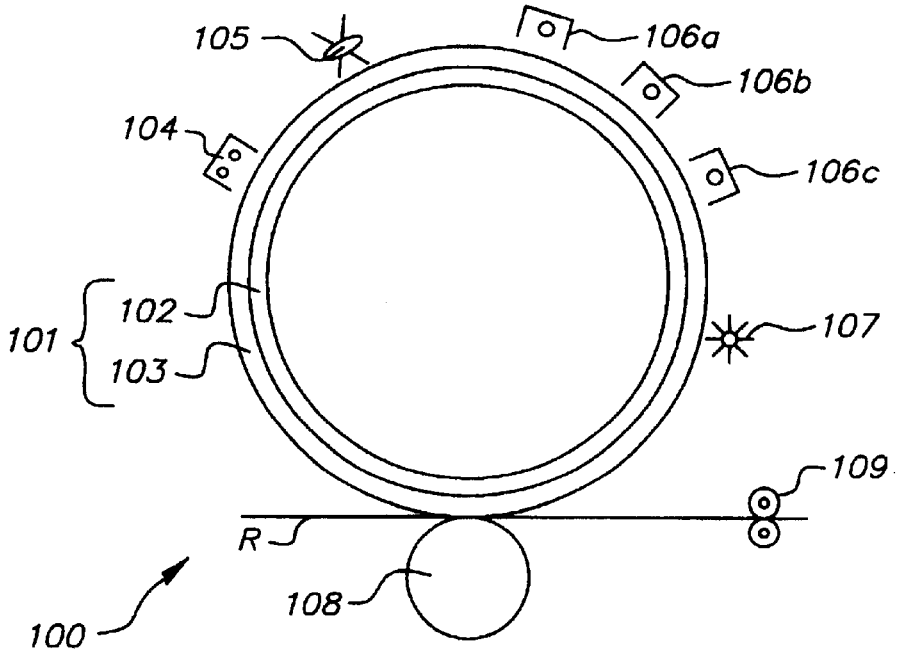
FIGS. 1 and 2 schematically depict embodiments of electrostatographic apparatus employed in the process of the present invention.
Figure 2:
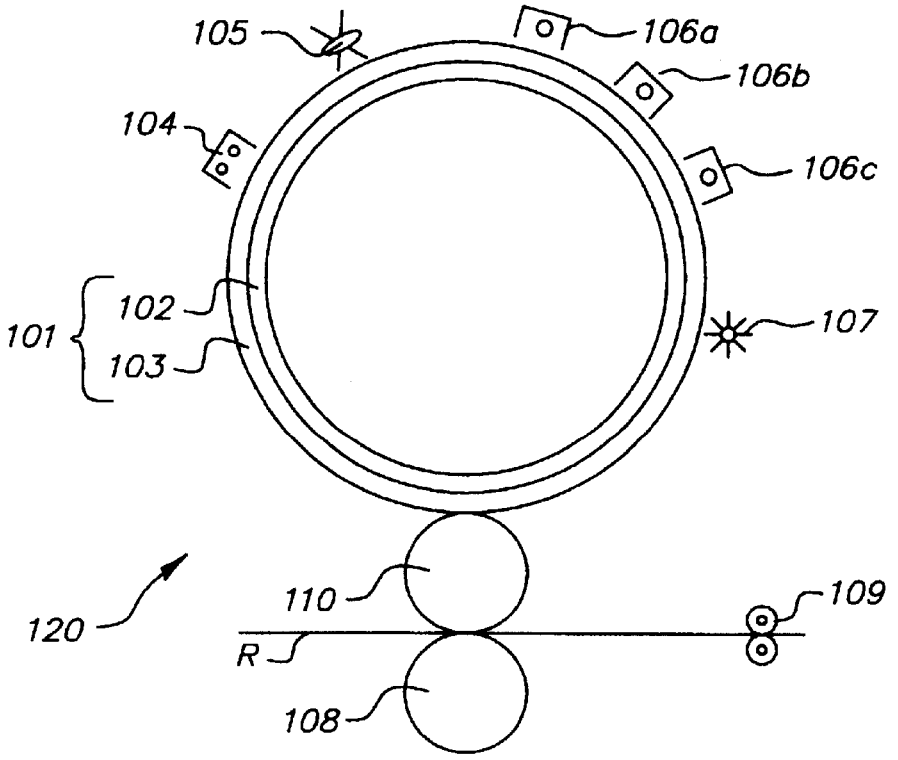

FIG. 1 schematically depicts apparatus 100 employed in the present invention, which includes a primary imaging member 101 having a photoconductive element 102 and a silicon carbide outermost layer 103. Organic photoconductors overcoated with hard materials, including silicon carbide, are described in the previously mentioned U.S. Pat. No. 5,807,651. Apparatus 100 also includes a charging station 104 comprising means for uniformly charging photoconductive element 101 to a desired surface potential of a first polarity, an exposing station 105 comprising means for imagewise exposing charged photoconductive element 101 to produce at least one electrostatic latent image, and at least one developing station 106*a* comprising means for developing the latent image to a first toned image. Apparatus 100 can include several developing stations containing different toners having selected properties such as color, which would useful for forming multi-color images. Three developing stations, 106*a*, 106*b*, and 106*c* are depicted in FIGS. 1 and 2. Apparatus 100 further comprises an optional charge erasing station 107 to remove residual surface charge from imaging member 101, which is then contacted with a receiver R at the electrically biased roller transfer assembly 108, causing the developed image to transfer to receiver R. Passing receiver R bearing the developed image through the fusing station 109 causes the image to be fused to receiver.

FIG. 2 is a schematic representation of apparatus 120 utilized in the practice of the present invention; it differs from apparatus 100 in that roller transfer assembly 108 further includes an intermediate transfer roller member 110 that can be electrically biased differently from roller transfer assembly 108.

One embodiment of the method of the present invention utilizes charged area development (CAD). In the CAD process, the polarity of the charge on the toner is opposite that of the initial charge on the photoconductive element comprising the primary imaging member. The development station is biased with a potential of the same polarity as the initial charge on the primary image bearing member. The potential of the development station is at a level lower than that of the initial charge on the photoconductive element but higher than that residing in the discharged areas of the element following imagewise exposure.

A preferred embodiment of the process of the present invention employs discharged area development (DAD). In DAD, the development electrode is biased to a potential of the same polarity as and slightly lower than the initial potential on the photoconductive element but greater than that of those portions of the element that are to bear toner. The toner used is charged to the same polarity as the initial charge on the photoconductive element.

An electrophotographic developer is used in the development station to tone the latent image in the discharged areas for DAD processes, or in the charged area for CAD processes. The developer is preferably a "two-component developer" comprising at least a toner and a carrier. In addition to these required constituents, the two-component developer can include various addenda known in the art, for example, submicrometer diameter "third component" particulate addenda such as silica, latex, strontium titanate, etc., which are commonly used to stabilize the toner charge, improve transfer, and assist flow. The carrier includes a magnetizable material and is intended to stay in the development station, preferably until worn out. The toner, which is charged opposite to the carrier and forms the toner image, is constantly replenished in the development station.

One development station that is particularly useful for producing high quality images is small particle dry (SPD) development station using magnetic brush development, as described by Fritz et al., U.S. Pat. No. 4,602,863, the disclosure of which is incorporated herein by reference. By rotating a magnetic core and using carrier particles having volume weighted diameters of about 30 $\mu$m, more uniform development of the electrostatic latent image can be obtained. With small toner particles, i.e., those having volume weighted diameters of less than 9 μm, preferably 6 μm or less (as measured using commercially available devices such as a Coulter Multisizer, sold by Coulter, Inc.), images having very high quality can be produced. Volume weighted diameter is defined as the mass of each particle times the diameter of a spherical particle of equal mass and density, divided by the total particle mass. The large number of relatively small carrier particles in the SPD process can be especially problematic in generating punctures in the charge-holding photoconductive layer of the primary imaging member.

The toned image is transferred to the receiver by a suitable transfer method utilizing biased roller charger included in the roller transfer assembly. The electric field created between the deposited charge and the electroconductive layer or substrate facilitates transfer of the toner to the receiver. The charge can also be contained in a roller in intimate contact with the backside of the receiver during transfer, causing a field to develop between the roller and the electrically conductive layer or substrate that facilitates toner transfer. In another preferred method of electrostatic transfer, an intermediate transfer element, typically a web or roller, is biased, and the image is transferred first to the intermediate transfer element and then to the receiver, which has had a backside charge deposited as described above. A particularly useful intermediate transfer element is one in which the element has a compliant outer layer.

The substrate in the primary imaging member of the apparatus comprises a substrate that can be either flexible or rigid for use in, for example, either a web or a drum format. Suitable materials for forming a substrate, which can be either electrically insulative or conducting, include polymers such as poly(ethylene terephthalate), nylon, polycarbonate, poly(vinyl butyral), poly(ethylene), etc., as well as aluminum, stainless steel, ceramics, ceramers, etc. If the substrate material is electrically insulating, it should be coated with a conductive layer such as nickel, copper, gold, aluminum, chromium, or conducting polymers, using a suitable process such as evaporation, sputtering, painting, solvent coating, etc. An electrically conductive substrate alone, or the combination of an insulating substrate and an electrically conductive layer, shall be referred to hereinafter as an "electrically conductive base."

The primary imaging member also preferably comprises one or more layers that singly or jointly are capable of holding an electric charge but can be image-wise discharged following the latent image forming and development process. These charge-holding layers, which preferably comprise materials with photoconductive properties and can further include charge generation and charge transport materials, are commonly referred to as "active layers". Active layers, which as prepared are continuous layers that do not contain any pinholes, can be affixed either directly to the electrically conductive base or to an intermediate layer. The intermediate layer, for example, may be designed to improve adhesion of the active layer to the electrically conductive base, to block unwanted charge injection into the active layer, etc., but it must not interfere with the charging and imagewise discharging of the active layer. Design and use of intermediate layers is well known to those skilled in the art.

As already noted, the primary imaging element can also comprise suitable additional layers such as, for example, one or more charge transport layers, charge generation layers, charge injection blocking layers, protective layers such as sol-gels, additional photoconductive layers that may be sensitive to different frequency light in the electrophotographic spectrum, etc. Preferred primary imaging members comprising organic photoconductive elements are commonly referred to as "organic photoconductors" (OPCs). OPCs comprise an electrically conductive base in electrical contact with at least one active layer comprising an organic photoconductive material. The base may be in one of many forms, for example, a drum, a web or belt, or a plate. The active layer is insulating in the dark but becomes conductive upon exposure to light. The OPC, which can comprise one or multiple active layers, typically contains one or more organic materials capable of the photogeneration of charge carriers (electrons or holes) and one or more organic materials capable of transport of the generated charge carriers.

Numerous materials have been described as being useful components of OPCs. These include organic compounds, both monomeric and polymeric, such as arylamines, arylmethanes, carbazoles, pyrroles, phthalocyanines, dye-polymer aggregates, and the like. Organic compounds are particularly useful for several reasons. They can be prepared as flexible layers; thus, the copier or printer architecture is not limited to a particular configuration. Furthermore, organic compounds have spectral sensitivities that can extend throughout the visible and into the near infrared regions of the spectrum and are amenable to low cost large area manufacturing processes.

In most OPCs, charge transport occurs through movement of a single type of charge carrier, electrons or holes, but not both. When only one carrier is mobile, trapped carriers of opposite sign can be created, resulting in a change in sensitometry of the active layer and in a phenomenon known as latent image hysteresis. One solution to the problem of latent image hysteresis is to separate the charge generation and transport functions into separate layers, referred to as the charge generation (CGL) and charge transport (CTL) layers, to form a dual or multi-layer photoconductive element.

A CGL is designed primarily for the photogeneration of charge carriers (holes and electrons), and a CTL is designed primarily for transportation of the generated charge carriers. Electrophotographic elements having one CGL and one CTL are commonly referred to as dual layer photoconductive elements. Representative patents disclosing methods and materials for making and using such elements include U.S. Pat. Nos. 5,614,342 to Molaire et al., 4,175,960 to Berwick et al., and 4,082,551 to Steklenski et al., the disclosures of which are incorporated herein by reference. Photoconductive elements containing one CTL and two CGLs are disclosed in U.S. Pat. No. 5,213,927 by Kan et al., the disclosure of which is incorporated herein by reference.

A charge transport layer (CTL) contains, as the active charge transport material, one or more organic materials that are capable of accepting and transporting charge carriers generated in the charge generation layer (CGL). Useful charge transport materials can generally be divided into two classes, those that preferentially accept and transport either positive charges (holes) or negative charges (electrons) generated in the CGLs. Examples of hole transport materials are arylamines, for example, triphenylamine; tri-p-tolylamine; N-N' diphenyl-N,N'-bis(3 -methylphenyl)-( 1,1'-biphenyl)-4,4' diamine; 1,1 -bis(di-4-tolylaminophenyl) cyclohexane; N,N',N",N'"-tetrakis(4-methylphenyl)-(1,1'-biphenyl)-4,4'-diamine; 4-(4-methoxystyryl)-4',4"-dimethoxytriphenylamine; N,N'-diphenyl-N,N'-di(m-tolyl)-p-benzidine; and mixtures thereof These and other useful arylamines are disclosed in U.S. Pat. Nos.5,332,635 to Tanaka; 5,324,605 to Ono et al.; and 5,202,207 to Kanemaru et al., the disclosures of which are incorporated herein by reference. Preferred arylamines are tri-p-tolylamine, 1,1

-bis(di-4-tolylaminophenyl)cyclohexane, and mixtures of these two materials. Other useful hole transport materials include arylalkanes, hydrazones, and pyrazolines.

Examples of electron transport materials include diphenoquinones, charge-transfer complexes of poly(N-vinylcarbazole):2,4,7-trinitro-9-fluorenone, and 2,4,7-trinitro-9-fluorenone.

In addition to the first charge transport material, the CTL may comprise one or more binder materials, one or more additional charge transport materials, and combinations thereof The binder and the additional charge transport materials can be one material or two or more different materials. Common binder types include polystyrenes, polycarbonates, and polyesters. One group of polyester binders useful in a charge transport layer is disclosed in U.S. Pat. No. 5,786,119 to L. J. Sorriero, M. B. O'Regan and P. M. Borsenberger, the disclosure of which is incorporated herein by reference. The disclosed polyester binders can be prepared using well known solution polymerization techniques such as disclosed in W. Sorenson and T. Campbell, Preparative Methods of Polymer Chemistry, page 137, Interscience (1968). Schotten-Baumann conditions were employed to prepare the following examples of useful polyester binders: poly{4,4'-isopropylidene bisphenylene terephthalate-co-azelate (70/30)}; poly{4,4'-isopropylidene bisphenylene terephthalate-co-isophthalate-co-azelate (50/25/25)}; poly{4,4'-isopropylidene bisphenylene-co-4,4'-hexafluoroisopropylidene bisphenylene (75/25) terephthalate-co-azelate (65/35)}; poly{4,4'-isopropylidene bisphenylene-co-4,4'-hexafluroisopropylidene bisphenylene (50/50) terephthalate-co-azelate (65/35)}; poly{4,4'-hexafluoroisopropylidene bisphenylene terephthalate-co-azelate (65/35)}; poly{hexafluoroisopropylidene bisphenylene terephthalate-co-isophthalate-co-azelate (50/25/25)}; and poly{4,4'-isopropylidene bisphenylene isophthalate-co-azelate (50/50)}.

The thickness of the charge transport layer can be varied, a preferred thickness being in the range from about 2 $\mu$m to about 50 $\mu$m (dry thickness), more preferably, from about 5 $\mu$m to about 20 $\mu$m.

One or more charge generation layers (CGLs) may be present in the OPCs in accordance with the present invention. Each CGL includes at least one charge generation material, which can comprise one or more dye polymer aggregates, phthalocyanines, squaranes, perylenes, azo-compounds or trigonal selenium particles. The CGLs may comprise a binder; however, certain charge generation materials may be vacuum deposited without a binder to form a CGL. Examples of charge generation materials, useful binders, and methods of preparing the CGL are disclosed in U.S. Pat. Nos. 4,886,722 to Law et al.; 4,895,782 to Koyama et al.; 5,330,865 to Leus et al.; and 5,614,342 to Molaire et al., the disclosures of which are incorporated herein by reference. Additional charge generation materials and various sensitizing materials such as spectral sensitizing dyes and chemical sensitizers may also be incorporated in each CGL.

The charge generation materials in each CGL can be the same or different and can be chosen, or can be combined with appropriate sensitizers, to be sensitive to the same or different wavelengths of radiation. A charge transport material can also be included in one or more of the charge generation layers. Examples of charge transport materials that are useful in charge generation layers include arylamines, particularly triarylamines, and polyarylalkanes, in particular 1,1-bis(di-4-tolylaminophenyl)-cyclohexane, and 4-N,N-(diethylamino)tetraphenylmethane. Different charge transport materials can be included in each of the charge generation layers of the photoconductive elements of the apparatus. For example, a triarylamine charge-transport material can be included in a first CGL and a polyarylalkane charge-transport material in a second CGL. Other sets of different materials can also be selected. Charge transport materials in the CTL can be the same as or different from any of the charge-transport materials in COLs.

Each CGL may comprise dye polymer aggregate charge generation material dispersed in an insulating polymeric binder. Examples of useful dye polymer aggregates for use in the charge generation layer are disclosed in U.S. Pat. Nos. 4,175,960 to Berwick et al. and 3,615,414 to Light, the disclosures of which are incorporated herein by reference.

Useful binders for CGL are known in the art and include, for example, polyesters, polystyrenes, and polycabonates such as LEXTAN™, available from General Electric Company, and MAKROLON™, available from Mobay, Inc.

Active layers, charge generation layers, and charge transport layers in primary imaging members in accordance with the present invention can optionally contain other addenda such as leveling agents, surfactants, plasticizers, sensitizers, contrast control agents, and release agents, as is well known in the art.

A useful thickness for each charge generation layer (CGL) is preferably within the range of from about 0.1 $\mu$m to about 15 $\mu$m (dry thickness), more preferably, from about 0.5 $\mu$m to about 10 $\mu$m.

The active layers in the primary image bearing elements of the electrostatographic apparatus can be affixed, if desired, directly to an electrically conductive base. Either a charge generation layer, a charge transport layer, or an active layer that both generates and transports charge may be in contact with the outermost layer. In some cases, it may be desirable to use one or more intermediate subbing layers or additional charge transport layers between the electrically conductive base and a CTL or a CGL, or between a CTL and a CGL to improve adhesion between a CTL, a CGL, and the electrically conductive base, and/or to act as an electrical barrier layer between the element and the electrically conductive base.

Electrically conductive bases include aluminum-paper laminates; metal foils such as aluminum foil, zinc foil, etc.; metal plates, such as aluminum, copper, zinc, brass and galvanized plates; vapor deposited metal layers such as silver, chromium, nickel, aluminum, and the like coated on paper or conventional photographic film supports such as cellulose acetate, polystyrene, poly(ethylene terephthalate), etc. Such conductive materials as chromium, aluminum, or nickel can be vacuum deposited on transparent film supports in sufficiently thin layers to allow electrophotographic elements prepared therewith to be exposed from either side of such elements.

In one method of preparation of the primary imaging members used in the apparatus and method of the invention, the components of a charge generation layer, or the components of a charge transport layer, including binder and any desired addenda, are dissolved or dispersed together in an organic solvent to form a coating composition, which is then solvent coated over an appropriate conductive support. The liquid is then allowed or caused to evaporate from the mixture to form the charge generation or charge transport layers.

Suitable organic solvents include aromatic hydrocarbons such as benzene, toluene, xylene and mesitylene; ketones such as acetone, butanone and 4-methyl-2-pentanone; halogenated hydrocarbons such as dichloromethane, 1,1,2-trichloroethane, chloroform and ethylene chloride; ethers including ethyl ether and cyclic ethers such as dioxane and tetrahydrofuran; other solvents such as acetonitrile and dimethylsulfoxide; and mixtures of such solvents. The amount of solvent used in forming the binder solution is typically in the range of from about 2 to about 100 parts of solvent per part of binder by weight, and preferably in the range of from about 10 to 50 parts of solvent per part of binder by weight.

In preferred coating compositions, the optimum ratios of both charge generation material and charge transport material to binder can vary widely, depending on the particular materials employed. In general, useful results are obtained when the total concentration of both charge generation material and charge transport material in the layers is within the range of from about 0.01 to about 90 weight percent based on the dry weight of the layers. In a preferred embodiment of a multilayer photoconductive element of the invention, the coating composition contains from about 0 to about 40 weight percent of charge transport material and from 0.01 to about 80 weight percent of charge generation material based on the weight of the layer.

Another method for deposition of an active layer, a single layer, a CTL or a CGL is vacuum evaporation. It is possible to deposit only one of the layers by vacuum evaporation and other layers by coating from a solution or to deposit some fraction of the layers by vacuum evaporation and the rest by coating from a solution. Plasma-deposited charge transport layers are also possible.

The primary image bearing element used in the electrostatographic apparatus in accordance with the present invention has an outermost layer of silicon carbide, preferably having silicon (Si) and carbon ( C) in an atomic ratio Si/C of about 0.25:1 to about 4:1, more preferably about 0.3:1 to about 4:1, most preferably about 0.8:1 to about 4:1. The silicon carbide in the outermost layer preferably has a Young's modulus of at least about 10 gigapascals (Gpa), more preferably, at least about 25 gigapascals (Gpa), as determined by any of a number of methods familiar to those skilled in the art, including Brillioun scattering in the bulk or coated silicon carbide, measurement of the velocity that sound travels through bulk silicon carbide, or use of a Hertzian indenter.

The outermost silicon carbide layer is preferably formed by plasma-enhanced chemical vapor deposition (PE-CVD) using an alternating current (AC) or direct current (DC) power source. The AC supply preferably operates in the radio or microwave frequency range. Selection of PE-CVD processing parameters, such as power source type or frequency, system pressure, feed gas flow rates, inert diluent gas addition, substrate temperature, and reactor configuration to optimize product properties is well known in the art. The outermost layer may comprise a single layer having a uniform composition or one or multiple layers of non-uniform compositions; however, it is preferred that the outermost layer be a single layer having a uniform composition.

Further, the outermost layer can be formed by a single or multiple passes through, for example, the PE-CVD apparatus or reactor; however, it is preferred that the outermost layer be formed by a single pass through the PE-CVD apparatus or reactor. PE-CVD reactors are commercially available from, for example, PlasmaTherm, Inc.

The atomic ratio Si/C in the outermost layer can be determined using X-Ray Photoelectron Spectroscopy (XPS). This is a well known technique for analyzing the composition of thin films. A typical measurement is described in detail in Example 2.

Preferred feed gases used to prepare the silicon carbide coating comprising the outermost layer include sources of carbon and of silicon. Carbon sources include hydrocarbon compounds such as paraffinic hydrocarbons represented by the formula $C_nH_{2n+2}$, where n is 1 to 10, preferably 1 to 4; olefinic hydrocarbons represented by formula $C_nH_{2n}$, where n is 2 to 10, preferably from 2 to 4; acetylenic hydrocarbons represented by $C_nH_{2n-2}$, where n is 2 to 10, preferably 2; alicyclic hydrocarbons; and aromatic compounds. A list of useful carbon source compounds includes, but is not limited to, the following: methane, ethane, propane, butane, pentane, hexane, heptane, octane, isobutane, isopentane, neopentane, isohexane, neohexane, dimethylbutane, methylhexane, ethylpentane, dimethylpentane, tributane, methyiheptane, dimethylhexane, trimethylpentane, isononane and the like; ethylene, propylene, isobutylene, butene, pentene, methylbutene, heptene, tetramethylethylene, hexene, octene, allene, methyl-allene, butadiene, pentadiene, hexadiene, cyclopentadiene, ocimene, alloocimene, myrcene, hexatriene, acetylene, allylene, diacetylene, methylacetylene, butyne, pentyne, hexyne, heptyne, octyne, and the like; cyclopropane, cyclobutane, cyclopentane, cyclohexane, cycloheptane, cyclooctane, cyclopropene, cyclobutene, cyclopentene, cyclohexene, cycloheptene, cyclooctene, limonene, terpinolene, phellandrene, sylvestrene, thujene, carene, pinene, bornylene, camphene, tricyclene, bisabolene, zingiberene, curcumene, humalene, cadinenesesquibenihene, selinene, caryophyllene, santalene, cedrene, camphorene, phyllocladene, podocarprene, mirene, and the like; benzene, toluene, xylene, hemimellitene, pseudocumene, mesitylene, prehnitene, isodurene, durene, pentamethyl-benzene, hexa-methylbenzene, ethylbenzene, propylbenzene, cumene, styrene, biphenyl, terphenyl, diphenylmethane, triphenylmethane, dibenzyl, stilbene, indene, naphthalene, tetralin, anthracene, and phenanthrene. The hydrocarbon compounds need not always be in their gas phase at room temperature and atmospheric pressure but can be in a liquid or solid phase insofar as they can be vaporized on melting, evaporation, or sublimation, for example, by heating or in a vacuum, in order to yield a gas phase of the hydrocarbon compound.

Sources of silicon include silane compounds such as, for example, silane ($SiH_4$), disilane ($Si_2H_6$), methylsilane, dimethylsilane, trimethylsilane, tetramethylsilane, ethylsilane, methylethylsilane, dimethylethylsilane, trimethylethylsilane, diethylsilane, diethylmethylsilane, dimethyldiethylsilane, triethylsilane, triethylmethylsilane, tetraethylsilane, ethylpropylsilane, diethylpropylsilane, diethyldipropylsilane, triethylipropyl silane, propylsilane, methylpropylsilane, dimethylpropylsilane, trimethylpropylsilane, dipropylsiane, dipropylmethylsilane, dipropylethylsilane, dimethyldipropylsilane, tripropylsilane, tripropylmethylsilane, tripropylethylsilane, tetrapropylsilane, and the like. Note that compounds containing both silicon and carbon can be used as both the silicon and the carbon source in a plasma-deposition. The sources of silicon need not always be in their gas phase at room temperature and atmospheric pressure but can be in a liquid or solid phase insofar as they can be vaporized on melting, evaporation, or sublimation, for example, by heating or in a vacuum, in order to yield a gas phase of the silicon compound.

Pure hydrogen may also be used as an additional feed gas. Mixtures of two or more types of hydrocarbons can be used with one or more silicon compounds. Mixtures of one or more silicon compounds, one or more hydrocarbons, and hydrogen can also be employed. Inert gases such as argon, helium, neon, xenon, and the like optionally may be fed into the reactor during the deposition of the outermost layers in order to control the properties of the coating. The use of inert gases to control coating properties is well known in the art.

The thickness of the outermost silicon carbide layer is preferably between about 0.05 μm and about 0.5 μm, more preferably between about 0.10 μm and about 0.35 μm.

Photoconductive Element A

Photoconductive Element A, a positive charging, multiactive photoconductive element, was prepared as follows: A CTL having a p-type charge transport material was coated onto a 7-mil thick nickelized poly(ethylene terephthalate) film support at a dry coverage of 13.72 g/m$^2$ (1.275 g/ft$^2$). The CTL mixture, comprising 60 wt % poly[4,4'-(2-norbornylidene)bisphenol terephthalate-co-azelate-(60/40)], 19.75 wt % 1,1-bis-[4-(di-4-tolylamino)phenyl] cyclohexane, 19.5 wt % tri-(4-tolyl)amine, and 0.75 wt % diphenylbis-(4-diethylaminophenyl)methane, was prepared at 10 wt % in a 70/30 (wt/wt) mixture of dichloromethane and methyl acetate. A coating surfactant, DC510, was added at a concentration of 0.024 wt % of the total CTL mixture.

A CGL was coated onto the CTL at a dry coverage of 6.57 g/m$^2$ (0.61 g/ft$^2$). The CGL coating mixture, comprising 49.5 wt % polycarbonate (Lexan™ available from GE), 2.5 wt % [poly(ethylene-co-2,2-dimethylpropylene terephthalate)], 39.25 wt % 1,1-bis-[4-(di-4-tolylamino) phenyl]cyclohexane, 0.75 wt % diphenylbis-(4-diethylamino phenyl)methane, 6.4 wt % 4-(4-dimethylaminophenyl)-2,6-diphenylthiapyrylium hexafluorophosphate, 1.6 wt % 4-(4-dimethylaminophenyl)-2-(4-ethoxyphenyl)-6-phenylthiapyryliumm fluoborate, and 2.4 wt % of the aggregate "seed" (a dried paste of the above CGL mixture that had been previously prepared), was prepared at 9 wt % in an 80/20 (wt/wt) mixture of dichloromethane and 1,1,2-trichloroethane. A coating surfactant, DC510 (Dow Corning Corporation), was added at a concentration of 0.01 wt % of the total CGL mixture.

The photoconductive element coated on the flat film support was converted to a belt configuration by ultrasonically welding two ends of the film together, and an outermost layer comprising silicon carbide and having a thickness of 0.1 μm was deposited onto the active layers using plasma-enhanced chemical vapor deposition in a Plasma II reactor. The belt was placed over two rollers in the plasma reactor, and the rollers were rotated by a chain loop driven by a DC motor. The belt was advanced at a rate of one revolution per 10 minutes, over a period of 40 minutes, between two parallel aluminum plates where the plasma is formed.

These plates, representing the anode and cathode, were 18.5 inches long by 19 inches high and were separated by approximately 1.5 inches. The cathode plate, which was in contact with the film, was 0.31 inches thick, and the opposite anode plate was 0.06 inches thick, the thickness of each plate thicknesses being selected to minimize thermal heating of the plate and avoid high temperature-induced damage to the film. The plates were situated in between the previously described two shafts such that the film passed between them as it rotated about the rollers.

To form a silicon carbide outermost layer, two gas mixtures were used: 10% silane ($SiH_4$) in hydrogen ($H_2$) and 25% methane ($CH_4$) in helium. The silane gas mixture flow rate was maintained at 25 sccm (standard cubic centimeters), the methane gas mixture flow rate at 350 sccm. System pressure was maintained at 0.7 Torr. The plasma was generated using an ENI Power System, Inc. model PL-1, AC power supply wired directly to the cathode plate, the ground lead being connected to the anode plate. The power level was maintained at 100 W.

Photoconductive Element B

Photoconductive Element B, a negative charging, multiactive photoconductive element not having a silicon carbide layer, was prepared as follows. A CGL was coated onto a 7-mil thick nickelized poly(ethylene terephthalate) support at a dry coverage of 6.57 g/m$^2$ (0.61 g/ft$^2$). The CGL coating mixture, comprising 49.5 wt % polycarbonate (Lexan™ available from GE), 2.5 wt % [poly(ethylene-co-2,2-dimethylpropylene terephthalate)], 39.25 wt % 1,1-bis-[4-(di-4-tolylamino)phenyl]cyclohexane, 0.75 wt % diphenylbis-(4-diethylaminophenyl)methane, 6.4 wt % 4-(4-dimethylaminophenyl)-2,6-diphenylthiapyrylium hexafluorophosphate, 1.6 wt % 4-(4-dimethylaminophenyl)-2-(4-ethoxyphenyl)-6-phenylthiapyrylium fluoborate, and 2.4 wt % of the aggregate "seed" (a dried paste of the above CGL mixture which had been previously prepared), was prepared at 9 wt % in an 80/20 (wt/wt) mixture of dichloromethane and 1,1,2-trichloroethane. A coating surfactant, DC510 (Dow Corning Corporation), was added at a concentration of 0.01 wt % of the total CGL mixture.

A CTL having a p-type charge transport material was coated onto the CGL at a dry coverage of 13.72 g/m$^2$ (1.275 g/ft$^2$). The CTL coating mixture, comprising 60 wt % poly[4,4'-(2-norbornylidene)bisphenol terephthalate-co-azelate-(60/40)], 19.75 wt % 1,1-bis-[4-(di-4-tolylamino) phenyl]cyclohexane, 19.5 wt % tri-(4-tolyl)amine, and 0.75 wt % diphenylbis-(4-diethylaminophenyl)methane, was prepared at 10 wt % in a 70/30 (wt/wt) mixture of dichloromethane and methyl acetate. A coating surfactant, DC510, was added at a concentration of 0.024 wt % of the total CTL mixture.

Photoconductive Element C

Photoconductive Element C, a multilayer inverse composite photoconductive element not having a silicon carbide layer, was prepared as follows: A CTL solution, prepared by dissolving 57.5 wt % bisphenol-A-polycarbonate MAKROLONTM™ 5705 (Mobay Chemical Company), 2.5 wt % of a copolymer containing 55% ethylene terephthalate and 45% neopentyl terephthalate, 20 wt % of 1,1-bis(di-4-tolylaminophenyl)-cyclohexane, and 20 wt % tri4-tolylamine, was diluted to a solution containing 10 wt % solids in dichloromethane. DC510 phenyl-methyl-substituted siloxane surfactant (Dow Corning) was added at a concentration of 0.01 wt % of the total CTL solution. The CTL solution was coated onto a 0.18 millimeter (7 mil) thick nickelized poly(ethylene terephthalate) support to give a CTL layer with a dry thickness of 8.5 μm.

A first CGL solution, CGL-I solution, prepared by dissolving 28.4 wt % bisphenol-A-polycarbonate MAKROLON™ 5705 (Mobay Chemical Company), 28.4 wt % bisphenol-A-polycarbonate LEXAN™ 145 (General Electric Company, New York), 1.6 wt % 4-(4-dimethylaminophenyl)-2,6-diphenylthiapyrylium hexafluorophosphate, 0.4 wt % 4-(4-dimethylaminophenyl)-2-(4-ethyoxyphenyl)-6-phenylthiapyrylium fluoroborate, and 39.2 wt % 1,1 -bis(di-4-tolylaminophenyl)-cyclohexane, and 2 wt % "seed", was diluted in a 70/30 w/w dichloromethane/1,1,2-trichloroethane solvent mixture to give a 10% solids solution. DC510 surfactant was added at a concentration of 0.01 wt % of the total CGL-I solution. The "seed" consisted of 2.3 wt % 4-(4-dimethylaminophenyl)-2,6-di-phenylthiapyrylium hexafluorophosphate, 1.5 wt % 4-(4-dimethylaminophenyl)-2-(4-ethyoxyphenyl)-6-phenylthiapyrylium fluoborate, 67.3 wt % bisphenol-A-polycarbonate MAKROLON™ 5705, and 28.9 wt % high molecular weight bisphenol-A-polycarbonate dissolved in a 70/30 w/w solvent mixture of dichloromethane and 1,1,2-trichloroethane. The CGL-I solution was coated on top of the CTL to give a CGL-I layer with a dry thickness of 10 $\mu$m.

A second CGL solution, CGL-ll solution, prepared by dissolving 51.2 wt % bisphenol-A-polycarbonate MAKROLON™ 5705, 6.3 wt % 4-(4-di-methylaminophenyl)-2,6-diphenylthiapyrylium hexafluorophosphate, 1.6 wt % 4-(4-dimethylaminophenyl)-2-(4-ethyoxyphenyl)-6-phenylthiapyrylium fluoroborate, 39.0 wt % 4-N,N-(diethylamino)tetraphenylmethane, and 1.9 wt % g "seed", was diluted with a 70/30 w/w dichloromethane/1,1,2-trichloroethane solvent mixture to give a 10% solids solution. DC510 surfactant was added at a concentration of 0.01 wt % of the total CGL-II solution. CGL-I1 solution was coated atop the CGL-I layer to give a CGL-II layer with a dry thickness of 4 $\mu$m.

Testing for Black Spot Formation

As already discussed, black spots arise in areas of the photoconductive elements that are damaged by contaminant fibers or particles on the surface of the element. The damage is characterized by holes in the surface of the element that in most cases extend down to the conductive layer. Carbon fibers used for structural reinforcement and static control in molded plastic parts included in electrophotographic apparatus are known to cause black spots. Other potential sources for such fibers are the anti-static brushes in use in some paper handling systems and in a film core on the backside of the primary image bearing element. Fiberglass fibers and strontium ferrite (Sr-Fe) particles, which may arise from the carrier particles in the developer station and the magnetic brush cleaners, are also known to cause black spots, which are the result of perforation by the contaminant fibers and particles of the photoconductive element of the primary imaging member, particularly in a roller transfer assembly of an electrophotographic apparatus.

The electrophotographic apparatus employed for evaluation of black spot formation includes a vacuum glass platen for holding a primary imaging member and a three-wire grid-controlled DC charger for depositing a uniform surface potential ($V_0$) on the photoconductive element of the imaging member. An exposure station is positioned following the charger; however the charged element is not exposed in the black spot formation test.

Three SPD development stations, as described above, are positioned after the exposing station, but just the first development station, loaded with 12 grams of developer at 10% toner concentration and having an applied voltage adjusted to minimize background and maximize toning potential, is used in the test.

Following the developer stations is a tungsten erase lamp that neutralizes any remaining charge on the photoconductive element. The final station is an electrostatic assist transfer roller assembly, which includes a roller that contacts the backside of the receiver and presses the receiver to the photoconductive element on the platen to transfer and fix the toner image. The transfer roller consists of a 2.25 inch (5.7 cm) diameter aluminum core that has been coated with polyurethane to a thickness of approximately 0.200 inches (0.5 cm). The coated roller has an electrical resistivity of approximately $2.5\times10^9$ ohm-cm and a durometer hardness reading of approximately 50 Shore A. A voltage (−1500 V) is applied to the core of the transfer roller, and the pressure at which the roller engages the platen is regulated to an average nip pressure of 6 psi by adjusting air pressure to a piston that raises the transfer roller. Under normal conditions, the roller is in a free-wheeling state and is driven by the friction between itself and the platen. The average pressure exerted on the primary imaging member by a roller in the roller transfer assembly is about 1 psi to about 10 psi.

Testing for black spot formation was carried out using the following procedure:

A primary imaging member is cut to provide a 5×8 inch (12.7×20.3cm) film sample, and a ground stripe of conductive lacquer is applied to one of the edges of the sample, which is then placed on the vacuum glass platen with the photoconductive and outermost layer, if present, facing away from the platen. The platen is secured and transported over the charging and developing stations in total darkness, using a sled assembly whose drive system is interfaced with a computer that maintains the sled velocity at specified values.

Following transfer of toner from the imaging member to a receiver in the transfer roller assembly and fusing of the transferred toner, the primary imaging member attached to the platen is cleaned with compressed air; 0.3 mg carbon fibers, which had been ground with a mortar and pestle, are deposited using tweezers on the center of the imaging member surface, in line with electrometer probes positioned after the exposing and developing stations. The primary imaging member is detached from the platen, positioned so that its surface is vertical in the cross-track direction, and tapped to remove excess carbon fibers. The imaging member with residual carbon fibers on its surface is returned to the platen and secured to the transport sled. A paper receiver is placed over the outermost layer of the imaging member, and the sled containing the imaging member/carbon fiber/receiver sandwich is positioned after the post-development erase lamp and transported through the transfer roller assembly at a rate of 2 inches per second (5.1 cm/s). After the sled emerges from the transfer assembly, the receiver is discarded, and the surface of the imaging member is cleaned with compressed air. A new receiver is placed on the imaging member, and the imaging member/receiver sandwich is transported over the charging, developing, and erasing stations and through the roller transfer assembly. The black spots on this receiver are analyzed; spots having a diameter greater than 1 mm are counted, at least three samples being used to determine a mean number of black spots.

Example 1

Photoconductive Element A containing the outermost layer of silicon carbide was tested for black spot formation as described above. The mean number of black spots per sample was 1.0.

Comparative Example 1

Photoconductive Element B was tested for black spot formation as described above. The mean number of black spots per sample was 5.3.

Comparative Example 2

Photoconductive Element C was tested for black spot formation in the process described above. The mean number of black spots per sample was 4.1.

Example 2

A second primary image bearing element useful in the apparatus and method of this invention was prepared by depositing an outermost layer comprised of silicon carbide using radio-frequency (RF) PE-CVD onto Photoconductive Element C. A commercial parallel-plate plasma reactor (PlasmaTherm Model 730) was used for deposition of the outermost layer onto Photoconductive Element C. The deposition chamber, having grounded walls with a diameter of 0.38 meter, consisted of two 0.28 meter outer diameter electrodes, a grounded upper electrode and a powered lower electrode. Removal of heat from the electrodes was accomplished via a fluid jacket. Four outlet ports (0.04 $m^3$), arranged 90° apart on a 0.33 meter-diameter circle on the lower wall of the reactor, led the gases to a blower backed by a mechanical pump. A capacitance manometer monitored the chamber pressure, which was controlled by an exhaust valve and controller. A 600-W generator delivered radio-frequency (RF) power at 13.56 MHz through an automatic matching network to the reactor. The gases used in the deposition flowed radially outward from the perforated upper electrode in a showerhead configuration in the chamber. Photoconductive Element C, on whose CGL-II layer the outermost layer was to be applied, was adhered to the lower electrode for deposition using double-stick tape.

A silicon carbide outermost layer having a thickness of 0.2 $\mu$m was deposited onto the photoconductive element at room temperature by introducing tetramethylsilane at 32 standard cubic centimeters per minute (sccm). The reactor pressure and RF power were 13.2 Pa and 100 W, respectively, and the deposition time was 2.5 minutes.

The composition of the outermost layer was analyzed using X-ray photoelectron spectroscopy (XPS). The XPS spectra were obtained on a Physical Electronics 5601 photoelectron spectrometer with monochromatic A1 K$\alpha$ x-rays (1486.6 eV). All spectra were referenced to the C 1s peak for neutral (aliphatic) carbon atoms, which was assigned a value of 284.6 eV. Spectra were taken at a 45° electron takeoff angle (ETOA) which corresponds to an analysis depth of about 5 nm. The XPS results showed the outermost layer of this Example had a Si/C ratio of 0.8.

The Young's modulus of the outermost layer, measured using a Hertzian indenter, was 34 GPa.

Examples 3–7

More primary image bearing elements useful in the apparatus and method of this invention were prepared as described in Example 2, except that the gases used in the plasma deposition of the outermost layer were varied. The compositions of the outermost layers were determined by XPS as described in Example 2. The feed gases used and the Si/C ratios for the outermost layers of the elements of these examples are shown in Table 1.

The Young's modulus of the outermost layer of Examples 5–7 was measured using a Hertzian indenter. The measured moduli of the outermost layers of Examples 5, 6, and 7 were 34 GPa, 27 GPa, and 37 GPa, respectively.

TABLE 1

| | Feed gases | | | |
|---|---|---|---|---|
| Example | Tetramethylsilane (sccm) | Acetylene (sccm) | Argon (sccm) | Si/C |
| 3 | 32 | 0 | 25.2 | 0.56 |
| 4 | 22.4 | 9.6 | 75.6 | 0.32 |
| 5 | 32 | 0 | 116 | 0.52 |
| 6 | 22.4 | 9.6 | 38.4 | 0.35 |
| 7 | 16 | 16 | 64 | 0.27 |

The invention has been described in detail with particular reference to certain preferred embodiments thereof, but it will be understood that variations and modifications can be effected within the spirit and scope of the invention.

What is claimed:

1. A process for reducing image defects in an electrostatographic image resulting from particulate contamination, said process comprising:

uniformly charging a primary imaging member included in an electrostatographic imaging apparatus subject to particulate contamination, said apparatus further including a charging station, an exposing station, at least one developing station, a transfer station having an electrically biased roller transfer assembly, a charge erasing station, and a developed image fusing station, said primary imaging member including a photoconductive element and an outermost layer of silicon carbide, said silicon carbide in said outermost layer having a Young's modulus of at least about 10 gigapascals;

imagewise exposing said primary imaging member at said exposing station, thereby forming a latent image on said imaging member;

developing said latent image with toner contained at said developing station, thereby forming a developed image on said primary imaging member;

passing said primary imaging member bearing said developed image past said charge erasing station, thereby removing residual surface charge from said imaging member;

contacting said primary imaging member bearing said developed image with a receiver by said electrically biased roller transfer assembly, causing said developed image to transfer to said receiver; and passing said receiver bearing said developed image through said fusing station, causing said developed image to be fused to said receiver; wherein, during the transfer step by said electrically biased roller, said silicon carbide layer serves to protect said photoconductive element against damage by contaminant particles present in said apparatus.

2. The process of claim 1 wherein said primary imaging member comprises an organic photoconductive element that includes one or more organic active layers.

3. The process of claim 2 wherein said one or more organic active layers comprise organic charge generation and charge transport materials.

4. The process of claim 1 adapted for discharged area development (DAD).

5. The process of claim 4 further comprising:

biasing said developing station at a potential at least lower than that of the initial potential on the primary imaging member but greater than that of portions of the primary imaging member that are to bear toner.

6. The process of claim 1 adapted for charged area development (CAD).

7. The process of claim 6 further comprising:

biasing said developing station at a potential level lower than that of the initial charge on the primary imaging member but higher than that residing in the discharged areas of the primary imaging member following image-wise exposure.

8. The process of claim 1 wherein said outermost layer of silicon carbide has an atomic ratio of silicon to carbon to about 0.25:1 to about 4:1.

9. The process of claim 8 wherein said outermost layer of silicon carbide has an atomic ratio of silicon to carbon of about 0.8: 1 to about 4: 1.

10. The process of claim 1 wherein said silicon carbide in said outermost layer has a Young's modulus of at least about 25 gigapascals.

11. The process of claim 1 wherein said outermost layer of silicon carbide is formed by plasma-enhanced chemical vapor deposition.

12. The process of claim 1 wherein said outermost layer of silicon carbide has a thickness of about 0.05 $\mu$m to about 0.5 $\mu$m.

13. The process of claim 12 wherein said outermost layer of silicon carbide has a thickness of about 0.10 $\mu$m to about 0.35 $\mu$m.

14. The process of claim 1 wherein said roller transfer assembly includes a roller transfer member, said member exerting an average pressure in contact with said primary imaging member of between about 1 psi to about 10 psi.

* * * * *